US005104329A

United States Patent [19]

Brown et al.

[11] Patent Number: 5,104,329

[45] Date of Patent: Apr. 14, 1992

[54] ELECTRICAL CONNECTOR ASSEMBLY

[75] Inventors: Jeffrey J. Brown, Harrisburg; Warren C. Hillbish, Hummelstown; Robert J. Hnatuck, Mechanicsburg; John W. Kaufman, Hershey; Douglas C. Rubendall, Millersburg, all of Pa.; Grover A. Zwieg, Oconomowoc, Wis.

[73] Assignee: AMP Incorporated, Harrisburg, Pa.

[21] Appl. No.: 767,344

[22] Filed: Sep. 27, 1991

Related U.S. Application Data

[63] Continuation of Ser. No. 691,167, Apr. 24, 1991, abandoned, which is a continuation of Ser. No. 586,360, Sep. 21, 1990.

[51] Int. Cl.[5] ..... H01R 4/66

[52] U.S. Cl. ..... 439/108; 439/609

[58] Field of Search ..... 439/92, 95, 108, 609, 439/511-515

[56] References Cited

U.S. PATENT DOCUMENTS

| | | | |
|---|---|---|---|
| 3,744,005 | 7/1973 | Sitzler | 439/108 X |
| 4,601,527 | 7/1986 | Lemke | 439/95 X |
| 4,655,518 | 4/1987 | Johnson et al. | 339/17 LC |
| 4,836,791 | 6/1989 | Grabbe | 439/95 X |
| 4,867,690 | 9/1989 | Thumma | 439/79 |
| 4,869,677 | 9/1989 | Johnson et al. | 439/80 |
| 4,959,024 | 9/1990 | Czeschka | 439/607 |

*Primary Examiner*—Eugene F. Desmond
*Attorney, Agent, or Firm*—Katherine A. Nelson

[57] ABSTRACT

An electrical connector assembly 10 includes a receptacle member 12 and a pin header 60. The receptacle member 12 has housing means 14 including an inner body portion 22 and two opposed outer side walls 24, which together define elongate cavities 36 between inner body section 22 and respective outer side walls 24; and a plurality of first contact terminal members 40 disposed in inner body portion 22 and a plurality of second contact terminal members 46 disposed in the elngate cavities 36. The pin header 60 includes a housing member 62 having a plurality of third electrical contact terminal members 78 disposed therein and adapted to mate with the first terminal members and at least one ground bus member 92 disposed continuously along at least one side of pin header housing 62, the bus member 92 being adapted to be received in one of the respective elongate cavities 36 of receptacle member 12 and electrically engage the second terminal members 46 therein, when the receptacle member 12 and pin header 60 are mated.

20 Claims, 12 Drawing Sheets

ELECTRICAL CONNECTOR ASSEMBLY

This application is a continuation of application Ser. No. 07/691,167 filed Apr. 24, 1991, now abandoned, in turn, a continuation of application Ser. No. 07/586,360 filed Sept. 21, 1990.

FIELD OF THE INVENTION

This invention relates to an electrical connector assembly for electrically interconnecting corresponding circuits between two circuit boards.

BACKGROUND OF THE INVENTION

Board to board connectors are used to interconnect circuitry on a plurality of daughter boards to a mother board or backplane. These boards may be mounted in a vertical or horizontal relationship depending upon the configuration of the mating connector members.

The demand for connectors that solve problems such as common mode noise and crosstalk has increased with the density and speed of electronic circuitry. It is desirable, therefore, to provide high density electrical connectors with means to provide a low inductance and low resistance ground connection from the connector to the circuit board to which it is attached.

U.S. Pat. No. 4,867,690 discloses an electrical connector system comprising a pin header having a plurality of rows of terminal members extending parallel to the sidewalls. The outermost rows of terminals adjacent the sidewalls are adapted to provide ground reference paths while the remaining rows of terminals are adapted to be mated to a receptacle member.

U.S. Pat. No. 4,655,518 discloses a two-piece connector assembly that provides grounding contacts along the dielectric sidewalls of the respective connectors. The terminal members of the pin header are positioned in recesses along the inside surfaces of the sidewall with the contact portion being a convex shape single resilient beam facing inwardly toward the pin terminals positioned between the sidewalls. In the receptacle member, ground contacts are placed along the outside surfaces of the sidewall so that they will slidably engage resilient beams in the pin header when the connectors are mated.

It is also desirable in certain applications to provide means for shorting together any two adjacent electrical contacts when a mating connector and board is removed from a system thereby providing a switching effect to maintain electrical continuity of the system. The "built in" switches eliminate the need for additional parts to provide the same capability.

For high density, high speed electronic systems it is generally desirable to provide means for shielding modules within the system for protection from EMI/RFI. It is desirable, therefore, that connector assemblies used within the system include means for facilitating interconnection of module shields to ground planes within the mother board or backplane. For purposes of this application, the terms "shielded pin header", "shielded receptacle" or "shielded connector assembly" are to be understood to mean members having a ground plate or other structure that provides the above described capability.

Furthermore, it is desirable that the mating members of grounded or shielded connector assembly also be matable with respective existing complementary non-grounded or shielded embers to provide a cost effective manner of upgrading existing electronic systems such as computers and instrumentation.

SUMMARY OF THE INVENTION

Accordingly, the present invention is directed to an electrical connector system that eliminates the problems and disadvantages of the prior art. The connector assembly includes a receptacle member and a pin header. The receptacle member has a housing member having a transverse body section extending between a mating face and a mounting face, an inner body portion and two opposed outer sidewalls extending from the mounting face to the mating face and defining elongate cavities between the inner body section and the respective outer sidewalls. The inner body portion has a plurality of terminal-receiving passageways extending therethrough from the mating face to the mounting face. A plurality of first contact terminals are disposed in respective ones of the terminal receiving passageways within the inner body portion. The first contact terminals are exposed along the mounting face for mounting to a circuit board. A plurality of second contact terminals are disposed in the transverse wall and have terminal sections extending into the elongate cavities, the second terminal members being adapted to mate with a ground bus or shielding means of a complementary mating connector. The pin header in accordance with the invention includes a housing member having mating and mounting faces, opposed sides, and a plurality of terminal-receiving passageways extending through the housing. A plurality of third electrical contact terminals are disposed in the respective terminal-receiving passageways and have at least a portion thereof exposed along the mating face for mating with the complementary receptacle member. The pin header further includes at least one ground plate member disposed continuously along at least one side thereof. The at least one ground plate member is adapted to be received in one of the respective elongate cavities of the receptacle member when the receptacle and pin header are mated.

An object of the present invention is to improve the electrical performance of the connector by providing additional low inductance and low resistance paths for ground current to flow through the electrical connector assembly to the circuit board.

It is also an object of the present invention to provide a means for shunting or switching adjacent contact terminals to provide electrical continuity upon removal of a board from a system, thereby eliminating the need to use additional components to provide the same function.

A further object of the invention is to provide a means for facilitating interconnection to a system shield.

An additional object is to provide a shielded connector system that is also compatible with existing unshielded connectors.

Some of the objects and advantages of the invention having been stated, others will appear as the description proceeds when taken in connection with the accompanying drawing.

DETAILED DESCRIPTION OF THE INVENTION

Figure 1:
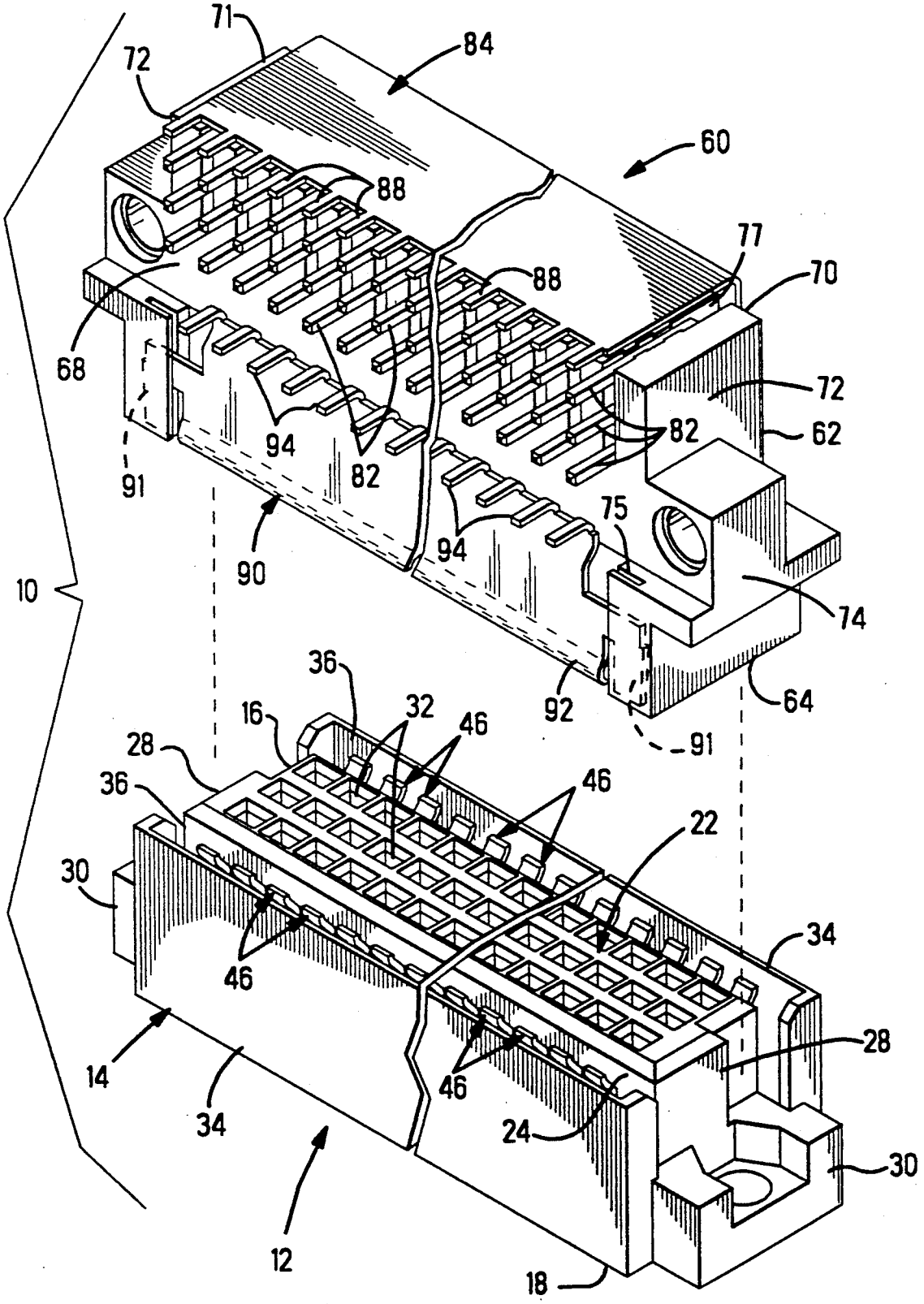
FIG. 1 is an enlarged fragmentary perspective view of the electrical connector assembly of the present invention with the receptacle and pin header members exploded from one another.
Figure 2:
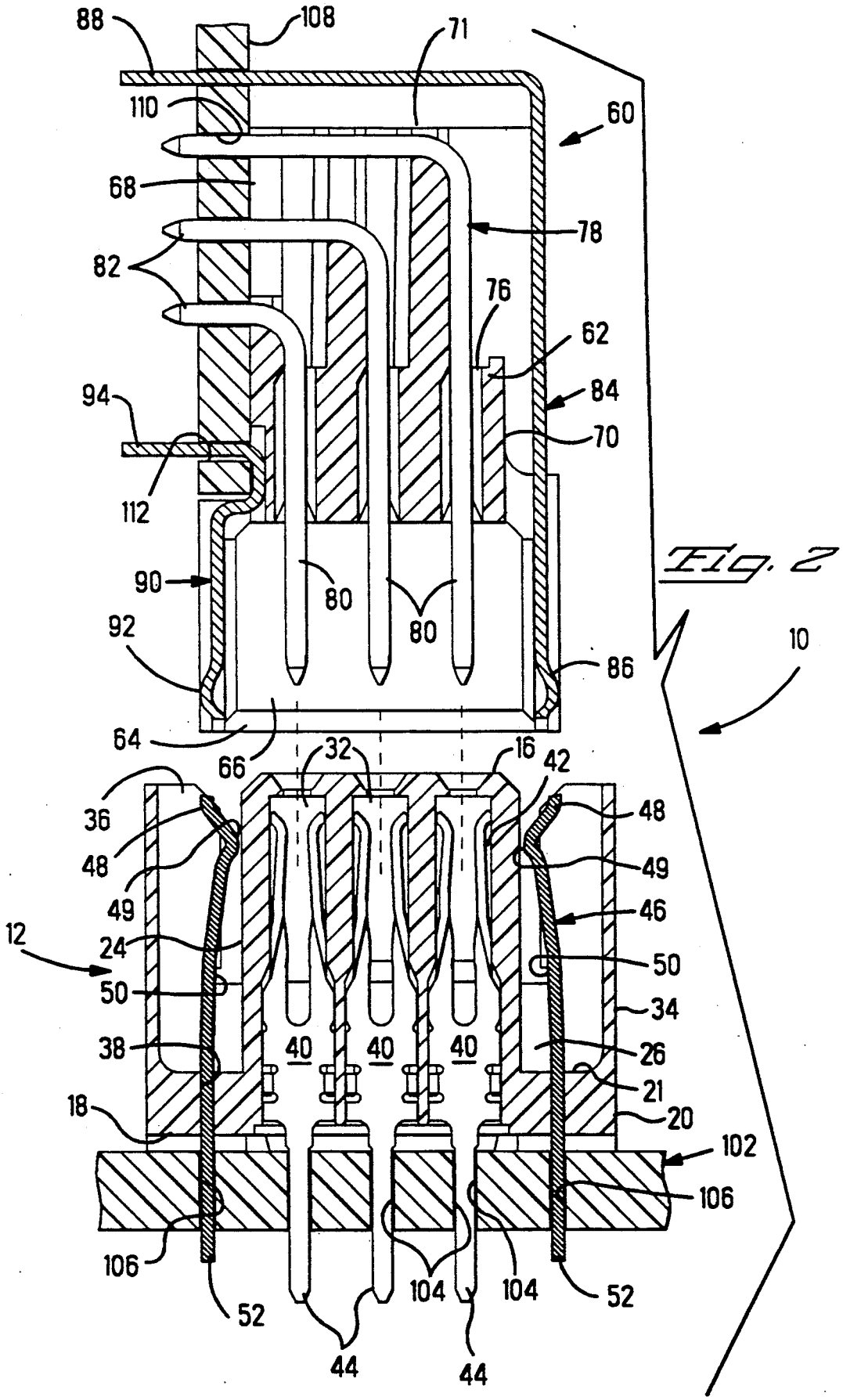
FIG. 2 is a cross sectional view of the connector assembly of the invention with the members exploded from each other.
Figure 3:
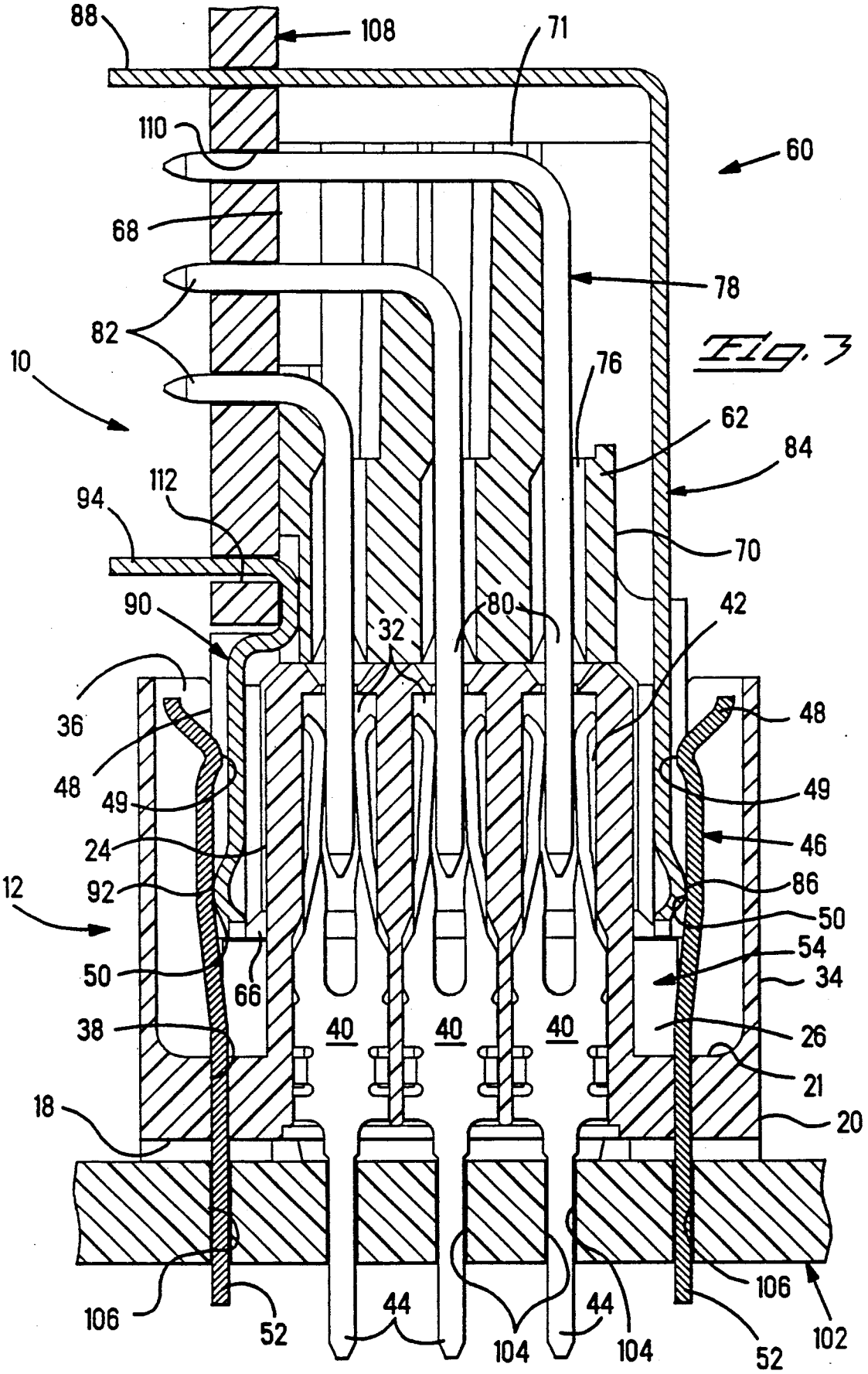
FIG. 3 is a cross sectional view of the mated connector assembly with the members mated.
Figure 4:
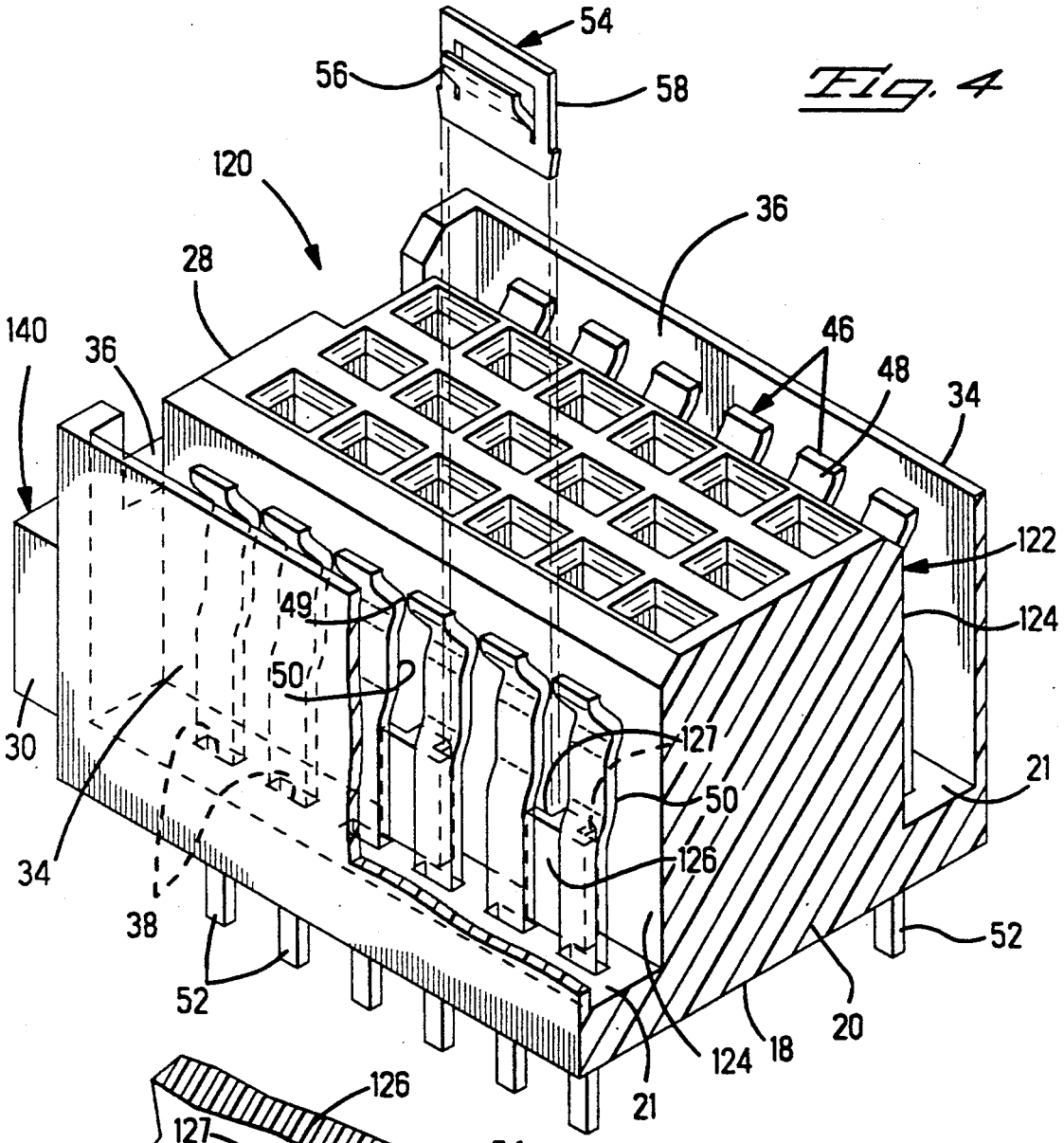
FIG. 4 is an enlarged fragmentary portion of an alternate embodiment of the receptacle member with a shunt terminal exploded therefrom.

Referring now to FIGS. 1, 2 and 3, the connector assembly 10 of the present invention comprises a receptacle member 12 and a pin header 60. For purposes of illustrating the invention, the board to board connector assembly 10 is shown in a configuration suitable for mounting daughter cards perpendicular to the mother board or backplane. It is to be understood that the pin header member can be modified for positioning the daughter cards in parallel with the mother board. Receptacle member 12 includes a housing member 14 having a mating face 16 and a mounting face 18. Housing 14 has a transverse body section 20 extending along the mounting face 18 as best seen in FIG. 4, an inner body portion 22 and opposed outer side walls 34 extending from mounting face 18 to mating face 16 and defining elongate cavities 36 between the inner body portion 22 and respective outer side walls 34. Inner body portion 22 includes opposed side walls 24, end walls 28 having mounting flanges 30 extending outwardly therefrom, and a plurality of terminal-receiving passageways 32 extending from the mounting face 18 to the mating face 16. A plurality of first contact terminal members 40 are disposed in respective passageways 32, as shown in FIGS. 2 and 3. For purposes of illustration, first terminal members 40 have been eliminated in FIGS. 1 and 4. First terminal members 40 include a first contact section 42 for mating with complementary terminal members 78 of pin header 60 and a second contact section 44 extending below the mounting face 18 for engagement with corresponding apertures 104 of the circuit board 102.

As seen in FIGS. 1-3 elongate cavities 36 are defined along thin sides by the inner surface of outer side walls 34 and the corresponding outer surfaces of body side walls 24 and the respective portions of transverse wall 20 extending therebetween forms cavity base 21. Cavity base 21 includes a plurality of apertures 38 extending therethrough. Receptacle 12 further includes a plurality of second contact terminal members 46 disposed in terminal-receiving apertures 38 of transverse wall 20 and having first contact sections 48 extending into elongate cavities 36 and a second contact section 52 extending outwardly from mounting face 18 for engagement with apertures 106 of mother board or backplane 102. As best seen in FIGS. 2 and 3, first terminal section 48 of respective second contact terminals 46 include cantilevered beam portions having an inwardly directed arcuate section 49 and a contact surface 50 intermediate arcuate section 49 and second contact section 52. Corresponding contact surfaces 50 of second terminal members 46 are adapted to mate with corresponding ground bus means 84, 90 of the complementary mating connector 60 as shown in FIG. 3.

Figure 4A:
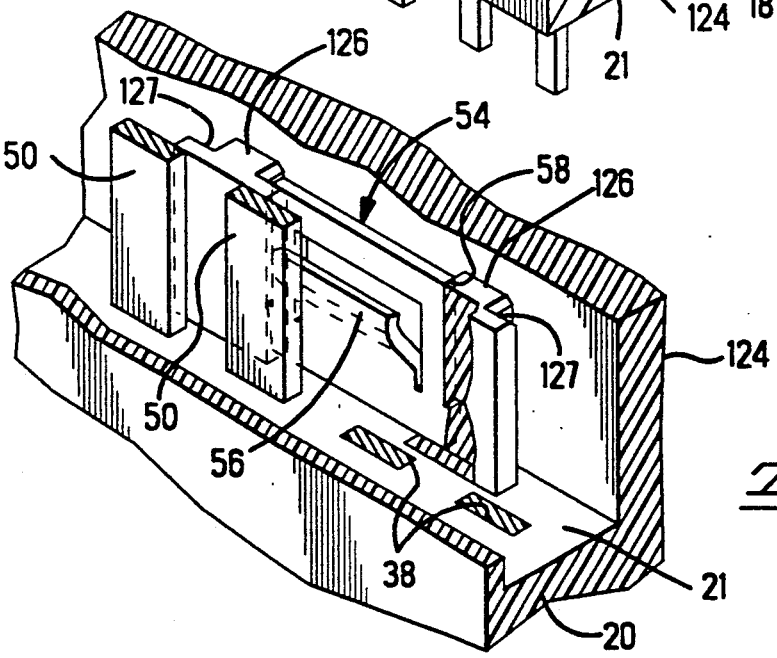
FIG. 4A is enlarged portion of the receptacle member of FIG. 4 illustrating the means for securing a shunt terminal to the housing sidewall.

FIGS. 4 and 4A illustrate an alternative receptacle member embodiment 120, which includes at least one shunt terminal member 54 to provide an internal "switching effect." Since the basic structure of receptacle member 120 is essentially the same as that of receptacle member 12, the same reference numerals have been used for the identical parts. Receptacle member 120 includes a housing member 140 having a transverse body section 20 extending along the mounting face 18 as best seen in FIG. 4, an inner body portion 122 and opposed outer side walls 34 extending upward from the mounting face 18 and defining elongate cavities 36 between the inner body portion 122 and respective outer side walls 34. Inner body portion 122 includes opposed side walls 124, end walls 28 having mounting flanges 30 extending outwardly therefrom. In this embodiment, the outside surfaces of side walls 124 of inner body portion 122 further include projections 126 extending into respective cavities 36 at selected locations therealong. Projections 126 include slots 127 for receiving a shunt terminal member 54 therebetween. Shunt terminal member 54 includes an outwardly extending portion 56 and ends 58, the ends 58 being received in projection slots 127 and extending between two adjacent second terminal members 46. As shown in FIG. 4A, shunt terminal member 54 electrically interconnects two adjacent second terminal members 46 within a respective cavity 36, when the receptacle member 120 is not mated to a complementary connector.

Figure 5:
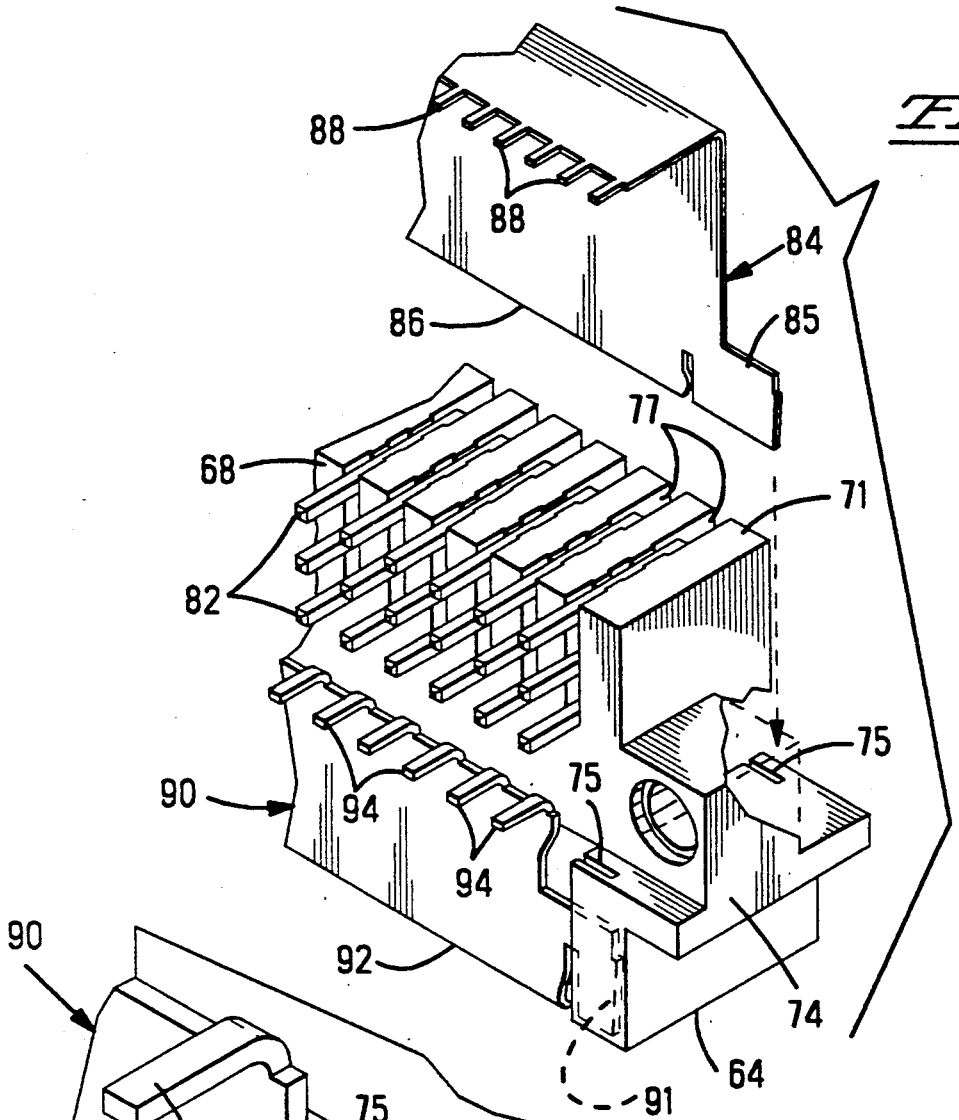
FIG. 5 is a fragmentary portion of the pin header member of the present invention with one of the ground plate shields exploded therefrom.
Figure 5A:
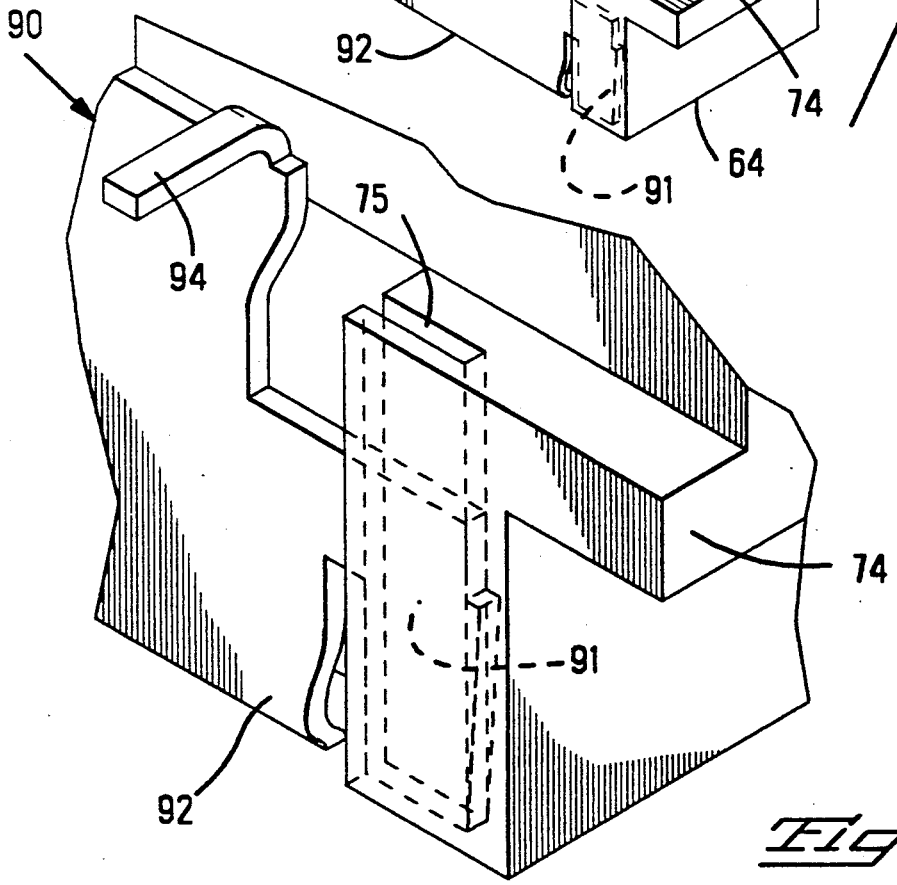
FIG. 5A is an enlarged fragmentary portion of FIG. 5 illustrating the means for securing the ground plate to the pin header.

Referring again to FIGS. 1-3, the pin header 60 of the present invention includes a housing 62 having a mating face 64 and mounting face 68. Cavity 66, configured to receive inner housing 22 of mating receptacle 12 therein, extends inwardly from mating face 64. For purposes of illustration, pin header 60 is shown in a right angle configuration for mounting to a daughter card 108. Pin header 60 includes side wall 70 opposed to mounting face 68, back wall 71 opposed to mating face 64, and opposed end walls 72 having outwardly extending flanges 74 thereon. Housing 62 further includes a plurality of terminal-receiving passageways 76 extending through the housing 62 and between the mating and mounting faces 64,68. A plurality of third terminal members 78 having first and second contact sections 80,82 are disposed within respective terminal-receiving passageways 76. As shown more clearly in FIG. 5, the terminal-receiving passageways 76 include slots 77 along the back wall 71 for assembling respective third terminal members 78 into the housing 62. First contact section 80 of each third terminal member 78 is shown as a pin member adapted for mating with a complementary first terminal member 40 and second contact section is adapted for mounting to corresponding apertures 110 of daughter card 108. Pin header 60 further includes first and second ground or shield plate means 84,90 disposed on outer surfaces of the connector with first ground plate means 84 extending along back wall 71 and side wall 70. The first ground plate 84 includes first and second connecting portions 86,88 respectively, the first ground connecting portion 86 being adapted for electrical connection with the second terminal members 46 in one of the cavities 36 of receptacle 12, as best seen in FIG. 3. The second ground plate 90 extends along the forwardly projecting portion of mounting face 68 of pin header 60 and is adapted to be received within the other of the elongate cavities 36 of the corresponding receptacle member 12 and to be electrically engaged to the plurality of second contact members 46 therein. As best seen in FIGS. 5 and 5A the ground plate members 84 and 90 include outwardly extending tabs 85,91 for being received into corresponding slots 75 in the outwardly extending flanges 74 to secure the ground plates 84,90 continuously along the corresponding sides of the housing member 62.

As shown in FIGS. 2 and 3 when pin header 60 is mated to the receptacle member 12 the outwardly extending contacts 86,92 on the ground plates 84,90 of pin header 60 will engage the corresponding ground contact terminals 46 of the receptacle member 12 prior to engagement of the respective first contact sections 42,80 of first and third terminal members 40,78. As the mating members are moved into mating engagement, the arcuate first contact sections 86,92 of the ground plates 84,90 enter respective cavities 36, outwardly deflect the cantilevered arms of second terminal members 46 and electrically engage the corresponding contact surfaces 50 of the second terminal members 46 within the respective cavities 36. Concomitantly herewith, the third terminal members 78 become fully mated with the corresponding first terminal members 40. The continuous shield on the outer surfaces of the pin header 60 facilitates interconnection to ground planes in the mother board or backplane and to shielding means in those applications where EMI/RFI protection is desired.

Figure 6:
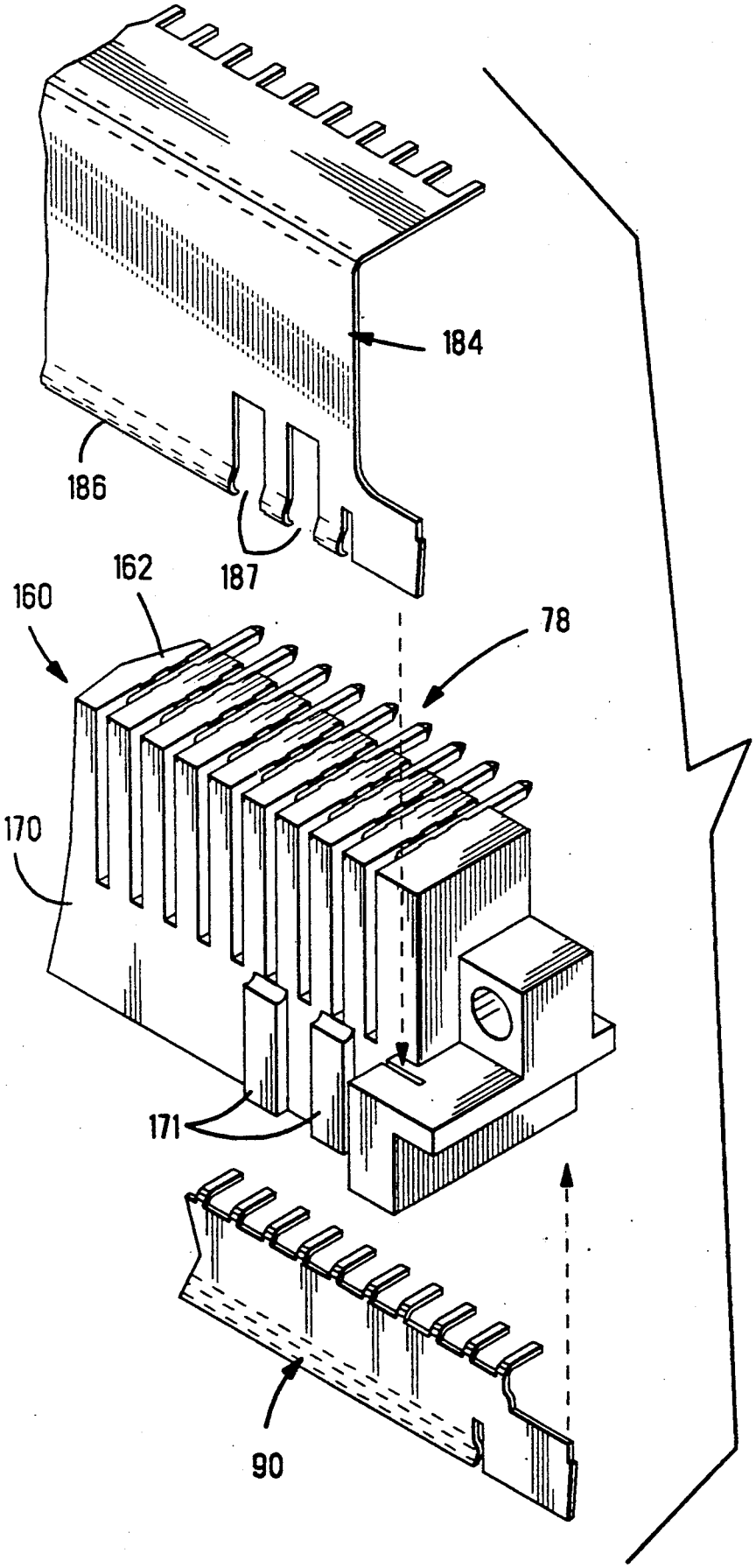
FIG. 6 is fragmentary perspective view of an alternative embodiment of the pin header for use with the receptacle member of FIG. 4.
Figure 7:
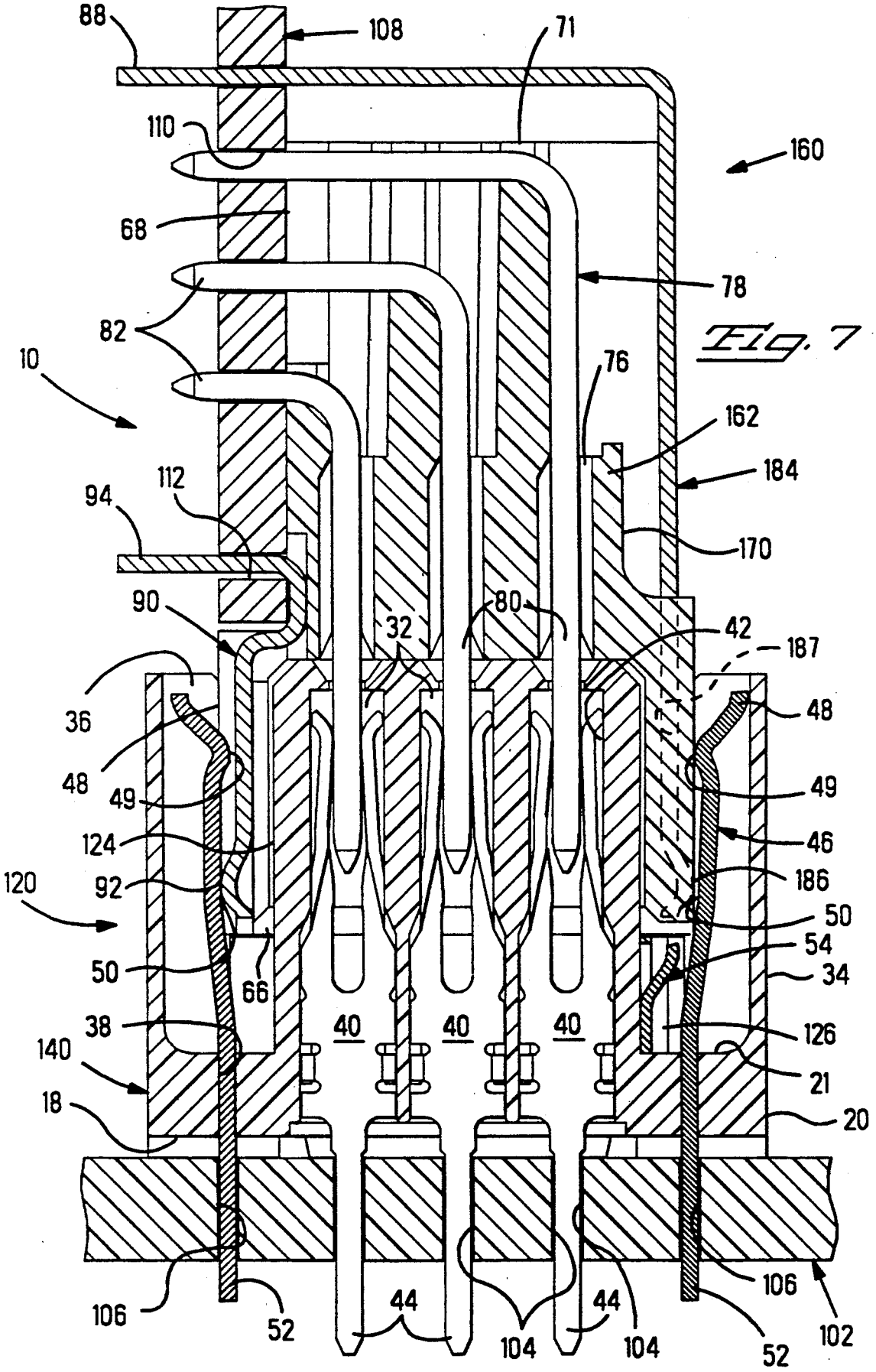
FIG. 7 is a cross sectional view of the receptacle member of FIG. 4 mated with the pin header of FIG. 6.

FIGS. 6 and 7 illustrate alternative pin header embodiment 160 for mating with receptacle member 120 of FIG. 4 having at least one shunt terminal member 54 disposed along a side wall 124. In this embodiment wall 170 of pin header housing member 162 includes at least one projection 171 extending outwardly therefrom at a location selected to correspond to the location of the shunt terminal member 54 of receptacle member 120 of FIG. 4. First plate member 184 includes at least one slot 187 extending thereinto from the edge of the first contact portion 186 at a location selected to correspond to the location of shunt terminal member 54 of receptacle member 120.

As shown in FIG. 7 when pin header 160 is mated to the receptacle member 120, the outwardly extending contacts 86,92 on the ground plates 84,90 of pin header 60 will engage the corresponding ground contact terminals 46 of the receptacle member 120 prior to engagement of the respective first contact sections 42,80 of first and third terminal members 40,78. As the mating members are moved into mating engagement, the outwardly extending projection 171 of housing member 162 disengages shunt terminal member 54 from engagement with the associated second terminal members 46 by deflecting the corresponding cantilevered arms outwardly and into the corresponding cavities 36. Slot 187 of plate 186 is of sufficient size to prevent engagement of plate member 186 with the formerly shunted second terminal members, thereby establishing switching capability for the connector assembly. The remaining terminal members electrically engaged their respective counterparts as previously described.

Figure 8:
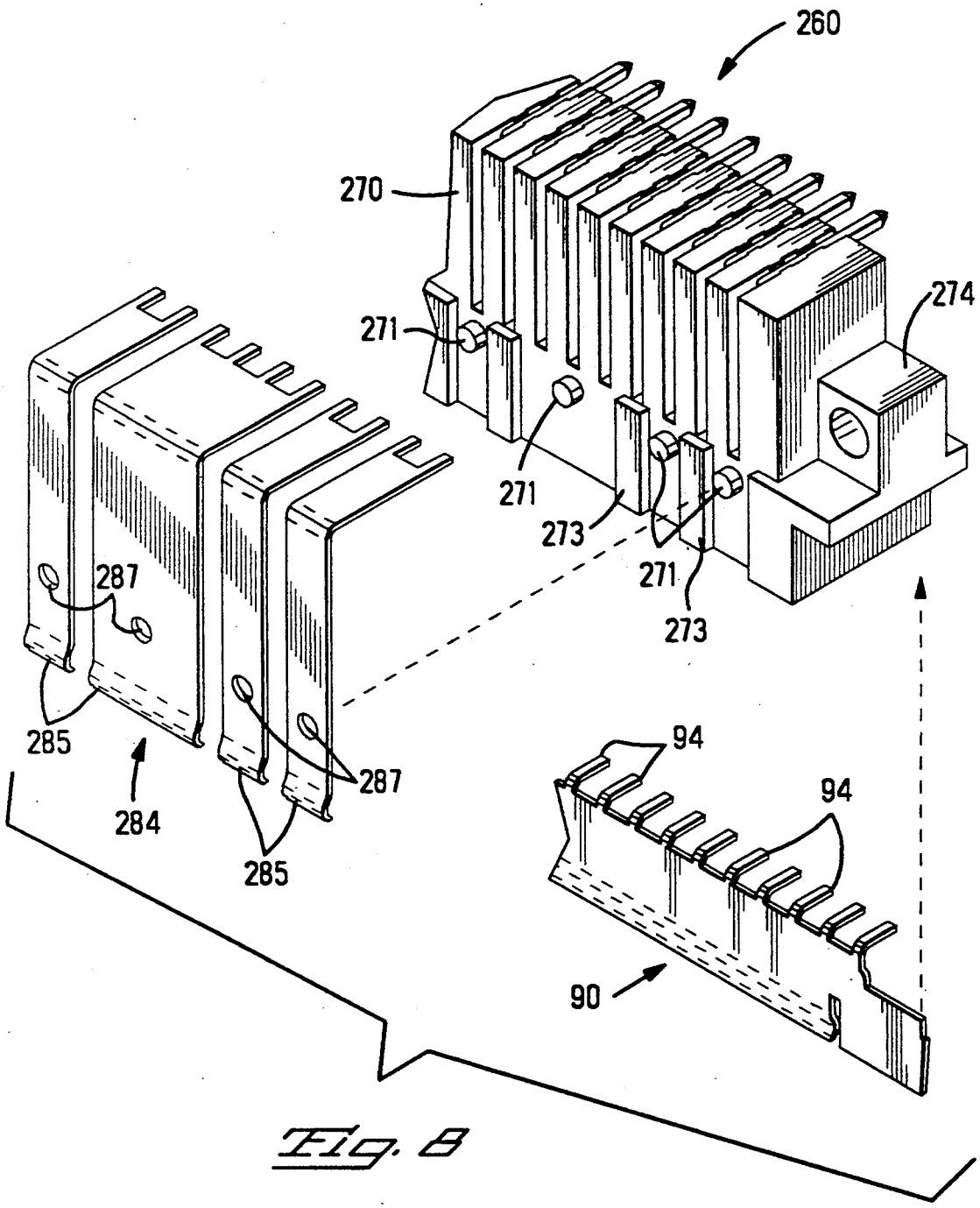
FIG. 8 is fragmentary perspective view of a pin header illustrating an alternate embodiment of the invention.

FIG. 8 shows a further alternative pin header embodiment 260 wherein first plate member 284 includes a plurality of segments 285, each including at least one aperture 287 therein for cooperating with projection means 271 on a wall 270 of pin header housing member 262. Wall 270 further includes a plurality of spacer members 273, which aid in keeping shield segments 285 from rotating. In the preferred embodiment plate segments 285 are heat staked to the housing wall. Only the second corresponding receptacle terminal members 46 (as shown in FIG. 1) associated with each individual segment 285 are commoned. By using a plurality of plate segments the individual segments can be used for interconnection of either signal, ground or power circuits, thereby increasing the capability of the connector assembly.

Figure 9:
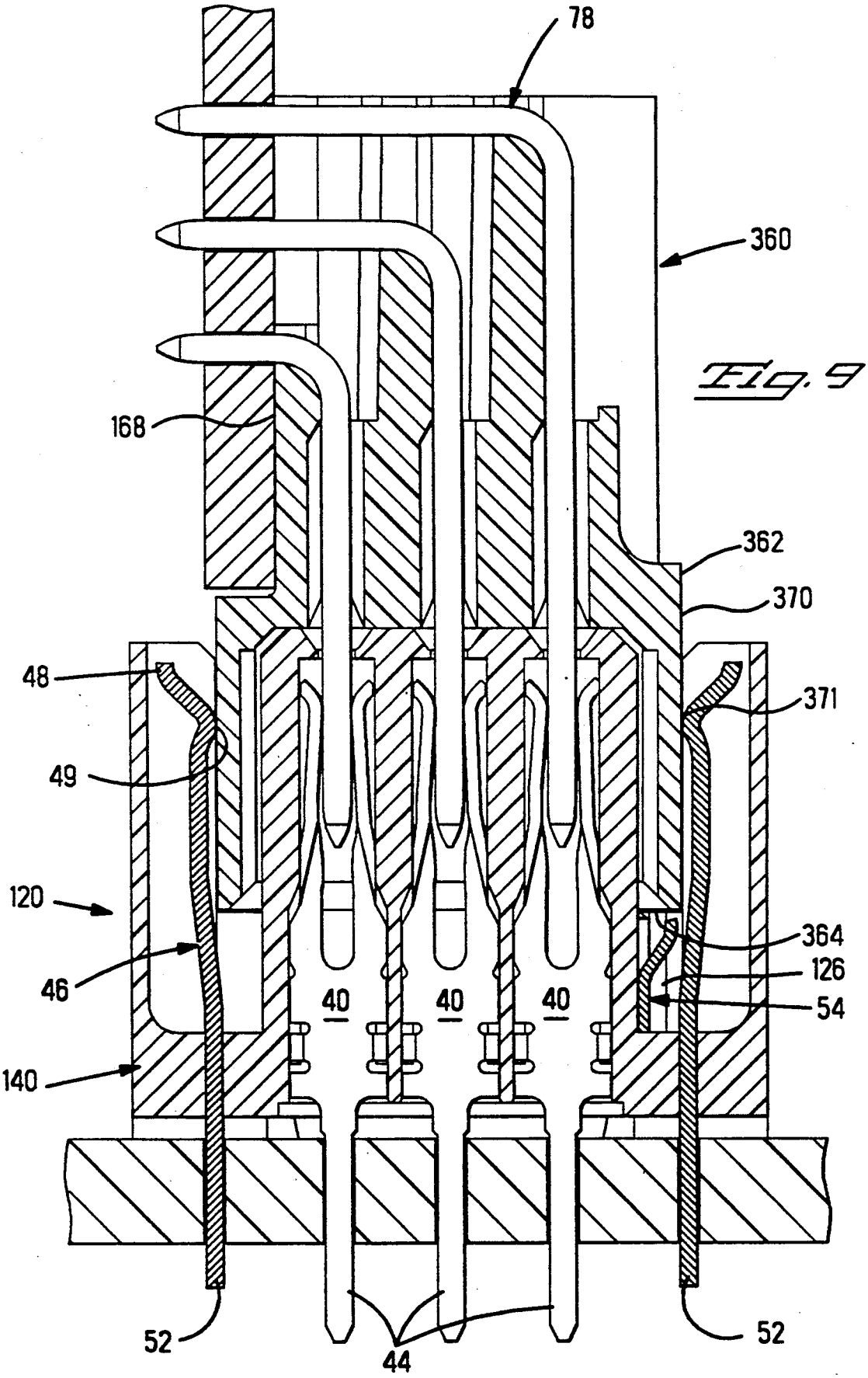
FIG. 9 is a cross sectional view of the receptacle of the present invention mated to an unshielded pin header member.

As is shown in FIG. 9, the receptacle 120 of the present invention is intermatable with an unshielded pin header 360 as well as the grounded or shielded pin header 60 of the present invention. When receptacle member 120 is mated with the unshielded pin header 360 presently available, the arcuate portion 49 of each of the second terminal members 46 engage the outer surface of dielectric housing 362. The electrical contact region 50 of receptacle member 120 is, therefore, protected from accumulating films or debris from the dielectric housing walls of the unshielded pin header 360. Thus, the same receptacle member 120 can be mated interchangeably with a shielded or grounded pin header or unshielded pin header 60,360 Any buildup of dielectric material on the second contact terminal 46 occurs at the arcuate portion 49 rather than the contact section 50.

Figure 10:
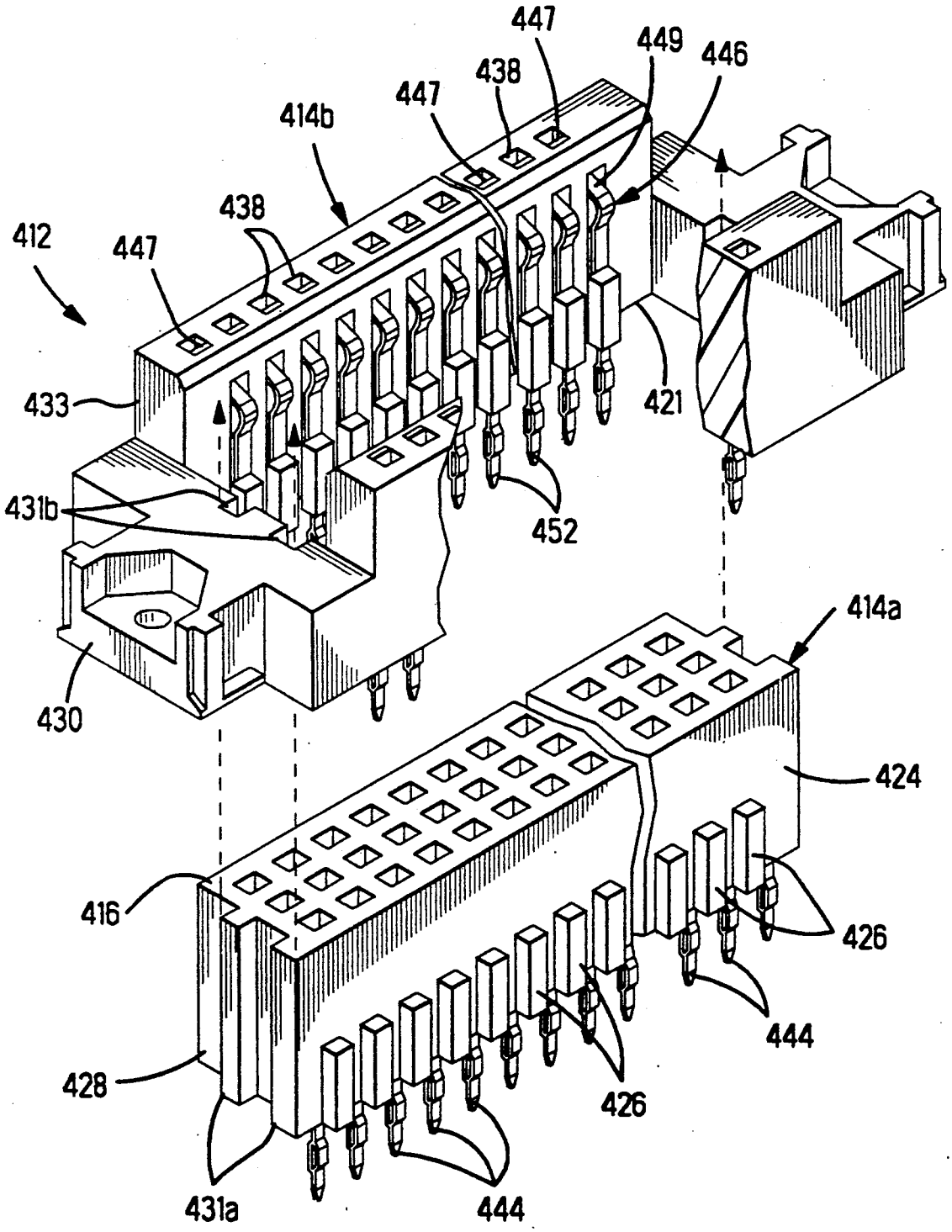
FIG. 10 is an exploded perspective view of a further alternative embodiment of the receptacle member.
Figure 11A:
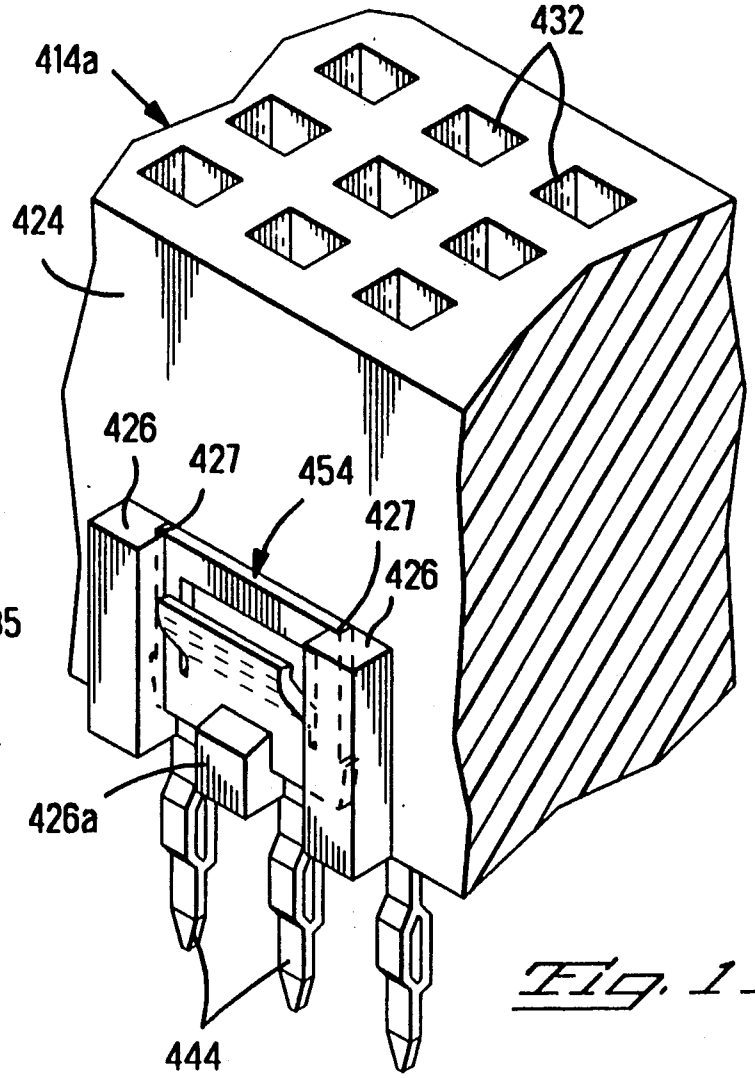
FIG. 11 and 11A are enlarged views of portions of the receptacle member of FIG. 10.
Figure 11:
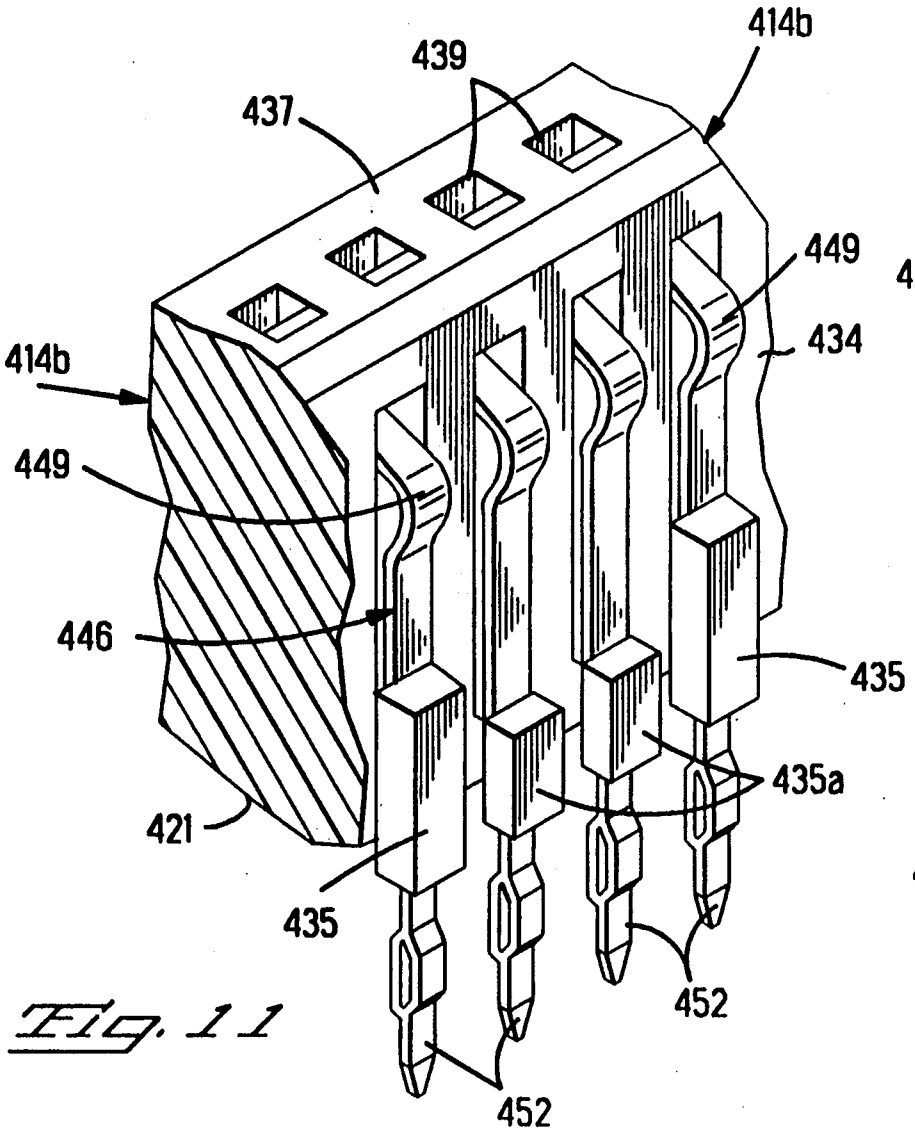
Figure 12:
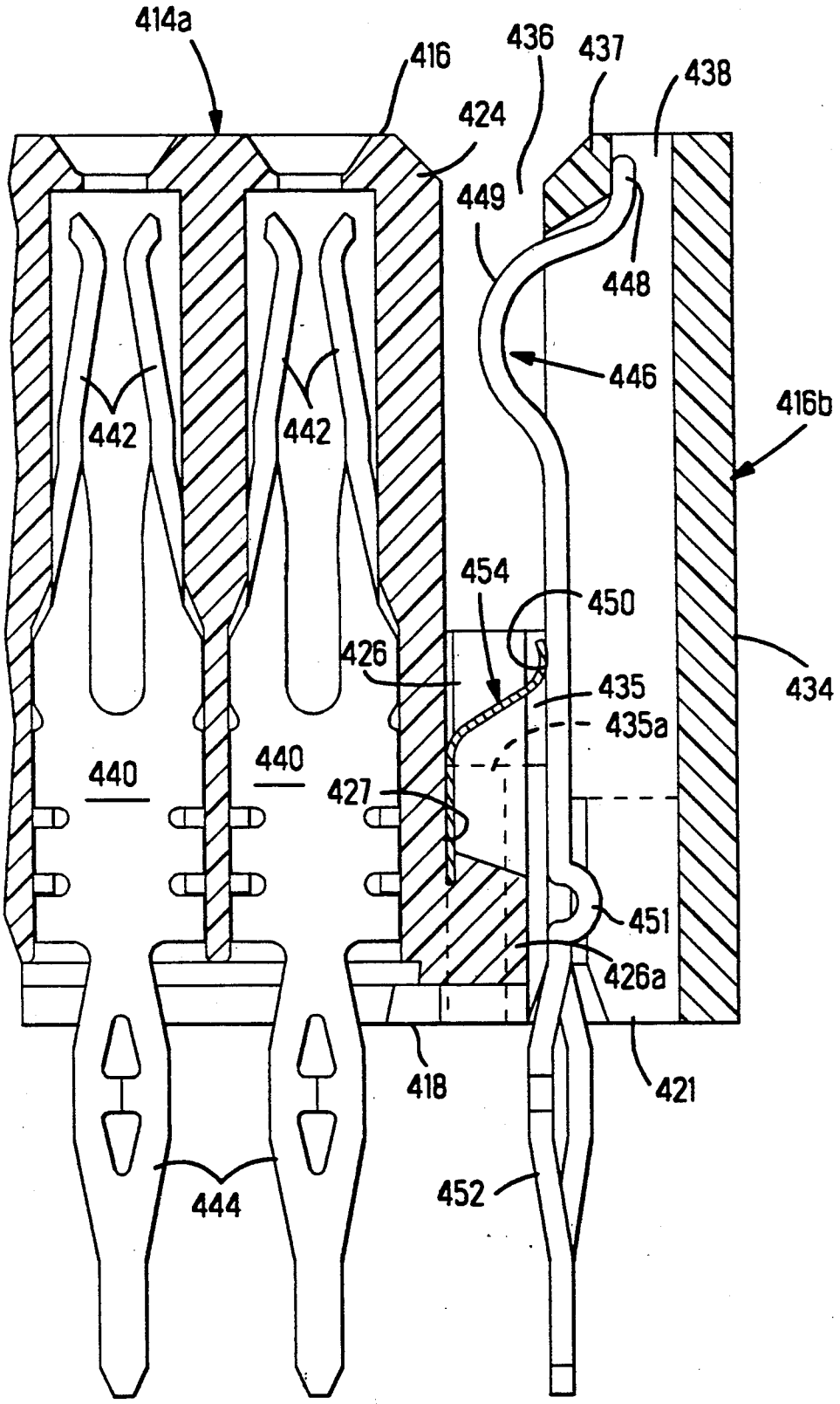
FIG. 12 is a cross sectional view of the assembled receptacle member of FIG. 10.

FIGS. 10–12 illustrate another alternative receptacle embodiment 412 wherein the housing means is comprised of first and second housing members **414*a* and 414*b*, which together define elongate cavities 436 extending between corresponding sides 424 and 434 of first and second housing members 414*a*,414*b* respectively, as best seen in FIG. 12. Housing members 414*a* and 414*b* are securable together along their respective longitudinal sides by respective interlocking "teeth" 426,435 and at the ends by interlocking teeth and groves, 431*a*,431*b*. First housing member 414*a* corresponds to the inner housing portion of the previously described embodiments and includes mating face 416, mounting face 418, side walls 424 and end walls 428. A plurality of spaced outwardly projecting teeth 426 extend along the outer surface of wall 424 proximate mounting face 418. A plurality of first terminal members 440 having first and second connecting portions 442,444, respectively are disposed in respective terminal-receiving passageways 432. Second housing member 414*b* is essentially a shell member having longitudinally extending side walls 434, end walls 433, and a plurality of terminal-receiving passageways 438 for receiving second terminal members 446 therein. Second terminal members 446 include first contact section 448 having an arcuate portion 449 adjacent free end 447 and second contact section 452 extending through lower second housing wall 421**.

The assembled receptacle 412 having a shunt terminal member 454 is shown in FIG. 12. FIGS. 11 and 11A show enlarged views of the respective interlocked walls 424,434 at a shunt location. Selected teeth 426 along wall 424 are provided with slots 427 for receiving ends of shunt terminal members 454 in a manner similar to that previously described. Housing wall 424 as shown in FIG. 11A, includes two such teeth 426 having a shunt terminal 454 disposed therebetween. Tooth 426*a* intermediate the modified teeth 426 has been shortened to accommodate the outwardly projecting contact surface 456 of shunt terminal 454. As seen more clearly in FIG. 11, the inner surfaces of wall 434 includes teeth 435 that are adopted to interlock with first housing member teeth 426 to secure the first and second housings together. This figure also shows the shortening of two of the teeth 435*a* at a shunt terminal location to accommodate the shape of the shunt terminal.

The housing members of the present invention are molded from a suitable dielectric material such as a glass-filled polyester or the like. The first and second terminal members are from a material having high spring characteristics such as stamped and formed phosphor bronze or the like. Since the third terminal members are not spring members they may be formed of brass or other suitable materials. Ground shields or plate members 84,90 are preferably made from a high conductivity brass. Preferably the shunt terminal members are made from beryllium copper. In assembling receptacle members shown in FIGS. 1–9, first terminal members are inserted into the terminal-receiving passageways from the mounting face and secured therein by means known in the art. Second terminal members are inserted into terminal-receiving passageways from the mating face and are secured therein as known in the art. If desired, shunt contacts are inserted at the appropriate locations along the housing sidewalls. The receptacle of FIGS. 10–12 is assembled by loading the first and second terminals into their respective terminal-receiving passageways and any shunt contacts into their respective locations. The two housing members are assembled by engaging the teeth along the sidewalls and sliding the members together. The assembled receptacle member can then be mounted to a board 102 by inserting respective second contact sections of the first and second terminal members into corresponding board apertures and are held thereon by appropriate means.

Pin header 60 is assembled by inserting third terminal members 78 into slots 77 along wall 70 of housing 62. The first and second ground plates 82,94 are assembled to housing 62 by inserting respective 85,91 into associated slots 75 to flanges 74.

In forming the plate members 84,90, it is preferable to include a plurality of second contact sections 84,90 respectively thereby providing multiple parallel paths to ground, thus lowering the inductance and resistance to ground.

In the preferred embodiment the number of outwardly extending second ground contact sections 88,94 of the plates 84,90 correspond to the number of columns of third terminal members 78 in the pin header 60 and the corresponding second terminal members 46 of the receptacle member 12 correspond to the columns of first terminal members 40 within the receptacle housing 14. The present invention provides a number of advantages for board to board connector systems. As is shown in the drawings a connector system is compatible with existing ungrounded/shielded connectors thereby permitting the user to gradually upgrade the system. Since the configuration of the basic pin header and basic receptacle member remains the same, both the enhanced and the standard pin header and receptacle member can be used interchangeably.

It is thought that the electrical connector assembly of the present invention and many of its attendant advantages will be understood from the foregoing description. It will be apparent that various changes may be made in the form, construction, and arrangement of the parts thereof without departing from the spirit or scope of the invention or sacrificing all of its material advantages.

We claim:

1. An electrical connector assembly comprising a receptacle member and a pin header:

said receptacle member including;

housing means having a mating face and a mounting face, said housing means including a transverse body section extending along said mounting face, an inner body portion and two opposed outer side walls extending from said mounting face to said mating face and defining elongate cavities between said inner body section and respective outer side walls;

said inner body portion having a plurality of terminal-receiving passageways extending therethrough from said mating to said mounting face;

plurality of first contact terminal members disposed in respective said terminal-receiving passageways of said inner body portion and at least exposed along said mating face for mating with complementary terminal members of a complementary mating connector; and a plurality of second contact terminal members disposed in said transverse wall and having terminal sections extending into said elongate cavities, said second terminal members being adapted to mate with ground bus means of a complementary mating connector; and said pin header adapted to mate with said receptacle member and including a housing member having a mating face, a mounting face, opposed sides, and a plurality of terminal-receiving passageways extending through said housing member form said mating face to said mounting face;

a plurality of third electrical contact terminal members disposed in respective said terminal-receiving passageways and at least exposed along said mating face and being adapted to mate with said first terminal members; and at least one ground plate member disposed continuously along at least one of said sides of said pin header housing member, said plate member being adapted to be received in one of said respective elongate cavities of said receptacle member and electrically engage said second terminal members therein when said receptacle member and said pin header are mated.

2. The connector assembly of claim 1 wherein said pin header includes at least one second ground plate member disposed along another side of said pin header housing member, said second plate member being adapted to be received in the other of said elongate cavities of said receptacle member and electrically engage said second terminal members therein.

3. The connector assembly of claim 1 wherein said at least one second ground plate member includes a plurality of segments adapted to be received in said other cavity whereby selected groups of associated second terminal members of said receptacle are commoned.

4. The connector assembly of claim 1 wherein said inner body portion of said receptacle member further includes means for securing a shunt terminal member thereto, said shunt terminal member being adapted to electrically common at least two adjacent second terminal members when said receptacle member is not mated to said pin header.

5. The connector assembly of claim 1 further including at least one shunt terminal member adapted to electrically common at least two of said second terminal members of said receptacle member.

6. The connector assembly of claim 1 wherein said housing means of said receptacle member comprises first and second housing members securable together to form said elongate cavities therebetween, said first housing member including said first terminal members and said second housing member including said second terminal members.

7. The connector assembly of claim 6 wherein said first housing member of said receptacle member further includes means for securing a shunt terminal member thereto, said shunt terminal member being adapted to electrically common at least two adjacent second terminal members when said first and second housing members are assembled together and said receptacle member is not mated to said pin header.

8. An electrical connector assembly comprising a receptacle member and a pin header:

said receptacle member including:

housing means having a mating face and a mounting face, said housing means including a transverse body section extending along said mounting face, an inner body portion and two opposed outer side walls extending from said mounting face to said mating face and defining elongate cavities between said inner body section and respective outer side walls;

said inner body portion having a plurality of terminal-receiving passageways extending therethrough from said mating to said mounting face;

a plurality of first contact terminal members disposed in respective said terminal-receiving passageways of said inner body portion and at least exposed along said mating face for mating with complementary terminal members of a complementary mating connector; and a plurality of second contact terminal members disposed in said transverse wall and having terminal section extending into at least one of said elongate cavities, said second terminal members being adapted to mate with ground bus means of a complementary mating connector; and said pin header adapted to mate with said receptacle member and including a housing member having a mating face, a mounting face, opposed sides, and a plurality of terminal-receiving passageways extending through said housing member from said mating face to said mounting face;

a plurality of third electrical contact terminal members disposed in respective said terminal-receiving passageways and at least exposed along said mating face and being adapted to mate with said first terminal members; and at least one ground member disposed along at least one of said sides of said pin header housing member, said at least one ground member being adapted to be received in one of said respective elongate cavities of said receptacle member when said receptacle member and said pin header are mated and said at least one ground member being disposed at a selected location opposing at least one of said plurality of second terminal members of said receptacle member to electrically engage therewith upon mating.

9. The connector of claim 8 wherein said at least one ground member defines a bus means and extends continuously along at least one side of said pin header.

10. An electrical connector assembly comprising a receptacle member and a pin header:

said receptacle member including:

housing means having a mating face and a mounting face, said housing means including a transverse body section extending along said mounting face, an inner body portion and two opposed outer side walls extending from said mounting face to said mating face and defining elongate cavities between said inner body section and respective outer side walls;

said inner body portion having a plurality of terminal-receiving passageways extending therethrough from said mating to said mounting face;

a plurality of first contact terminal members disposed in respective said terminal-receiving passageways of said inner body portion and at least exposed along said mating face for mating with complementary terminal members of a complementary mating connector; and at least one second contact terminal member disposed in said transverse wall and having a terminal section extending into at least one of said elongate cavities, said at least one second terminal member being adapted to mate with ground bus means of a complementary mating connector; and said pin header adapted to mate with said receptacle member and including a housing member having a mating face, a mounting face, opposed sides, and a plurality of terminal-receiving passageways extending through said housing member from said mating face to said mounting face;

a plurality of third electrical contact terminal members disposed in respective said terminal-receiving passageways and at least exposed along said mating face and being adapted to mate with said first terminal members; and at least one ground member disposed along at least one of said sides of said pin header housing member, said at least one ground member being adapted to be received in one of said respective elongate cavities of said receptacle member when said receptacle member and said pin header are mated and said at least one ground member being disposed at a selected location opposing said at least one second terminal member of said receptacle member to electrically engage therewith upon mating.

11. The connector assembly of claim 10 wherein said at least one ground member defines a bus means and extends continuously along at least one side of said pin header.

12. An electrical receptacle member comprising:

housing means having a mating face and a mounting face, said housing means including a transverse body section extending along said mounting face, an inner body portion and two opposed outer side walls extending from said mounting face to said mating face and defining elongate cavities between said inner body section and respective outer side walls;

said inner body portion having a plurality of terminal-receiving passageways extending therethrough from said mating to said mounting face;

a plurality of first contact terminal members disposed in respective said terminal-receiving passageways of said inner body portion and at least exposed along said mating face for mating with complementary terminal members of a complementary mating connector; and a plurality of second contact terminal members disposed in said transverse wall and having terminal sections extending into at least one of said elongate cavities, said second terminal members being adapted to mate with ground bus means of a complementary mating connector.

13. The electrical receptacle member of claim 12 further including at least one shunt terminal member adapted to common at least two of said second contact terminal members when said receptacle member is not mated to a complementary connector.

14. The electrical receptacle member of claim 12 wherein said inner body portion further includes means for securing at least one shunt terminal member thereto, the shunt terminal member being adapted to electrically common at least two adjacent second terminal members when said receptacle member is not mated to a complementary connector.

15. An electrical receptacle comprising:

first and second housing portions secured together to form a housing member having a mating face and a mounting face, said housing member including a transverse wall extending along said mounting face, said first body portion defining an inner body section having a plurality of terminal-receiving passageways extending therethrough from said mating to said mounting face and said second body portion including two opposed outer side walls extending from said mounting face and said second body portion including two opposed outer side walls extending from said mounting face to said mating face and two opposed end walls, said first and second housing portions being secured together to define elongate cavities between said inner body section and respective outer side walls;

a plurality of first contact terminal members disposed in respective said terminal-receiving passageways of said inner body portion and at least exposed along said mating face for mating with complementary terminal members of a complementary mating connector;

a plurality of second contact terminal members disposed in said transverse wall and having terminal sections extending into at least one of said elongate cavities, said second terminal members being adapted to mate with ground bus means of a complementary mating connector; and means securing said second housing portion around said first housing portion.

16. The electrical receptacle of claim 15 wherein said first and second housing portions are secured to each other by a plurality of complementary force fit members.

17. The electrical receptacle of claim 15 wherein said second terminal members are disposed in said second housing portion.

18. The electrical receptacle of claim 16 wherein said first and second terminal members include respective portions extending beyond the mounting face of said housing means, the portions being adapted to be secured to a securable to a common circuit board by said securing portions of said first and second terminal members, said first and second housing portions being in a surrounding relationship to each other.

19. The electrical receptacle of claim 15 wherein said first housing portion of said housing member further includes means for securing a shunt terminal member thereto, said shunt terminal member being adapted to electrically common at least two adjacent second terminal members when said first and second housing portions are assembled together and said receptacle member is not mated to said complementary connector.

20. The electrical receptacle of claim 12 wherein said housing means comprises first and second discrete portions, and said receptacle further including means for securing said second portion around said first portion.

* * * * *